US006367439B1

(12) United States Patent
Nishioka et al.

(10) Patent No.: US 6,367,439 B1
(45) Date of Patent: Apr. 9, 2002

(54) COMBINATION BODY OF SHIM AND CAM

(75) Inventors: Takao Nishioka; Takatoshi Takikawa, both of Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/280,994

(22) Filed: Mar. 30, 1999

(30) Foreign Application Priority Data

Mar. 31, 1998 (JP) ..... 10-084800

(51) Int. Cl.[7] ..... F01L 1/16; F01L 1/20

(52) U.S. Cl. ..... 123/90.51; 123/90.6; 74/566; 74/569; 428/408; 428/472; 428/698

(58) Field of Search ..... 428/408, 698, 428/469, 472; 123/90.6, 90.51, 446, 456; 74/566, 569

(56) References Cited

U.S. PATENT DOCUMENTS

| | | | | |
|---|---|---|---|---|
| 4,365,765 A | * | 12/1982 | Schneeberget et al. | 242/43 R |
| 5,082,433 A | | 1/1992 | Leithner | |
| 5,205,188 A | | 4/1993 | Repenning et al. | |
| 5,372,099 A | * | 12/1994 | Matsunuma et al. | 123/90.48 |
| 5,490,730 A | * | 2/1996 | Akita et al. | 284/902 |
| 5,647,313 A | * | 7/1997 | Izumida et al. | 123/90.51 |

FOREIGN PATENT DOCUMENTS

| | | | |
|---|---|---|---|
| DE | 4423543 A1 | | 3/1995 |
| EP | 0651140 A1 | | 5/1995 |
| EP | 0694362 A1 | | 1/1996 |
| GB | 1462766 | | 1/1977 |
| JP | 06-294307 | | 10/1994 |
| JP | 60-294307 | * | 10/1994 |
| JP | 07-098052 | | 4/1995 |

OTHER PUBLICATIONS

1 Page Korean Patent Office Search Report.

* cited by examiner

*Primary Examiner*—Archene Turner
(74) *Attorney, Agent, or Firm*—McDermott, Will & Emery

(57) ABSTRACT

In a combination of the shim 5 and cam 1 for use in a reciprocating mechanism portion, the shim 5 is made of a material having a hardness higher than that of the sliding surface of the cam 1 and the sliding surface of the shim 5 is finished to within a range of the surface roughness of $R_z$0.07–0.2 $\mu$m in 10-point mean surface roughness and further the sliding surface of the cam 1 is provided with open pores 1*b*. In the above combination, the generated torque and the wear of sliding portion are minimized by selecting a shim member whose surface roughness is difficult to deteriorate due to plastic deformation by a injection pump contact with a mating member and corrosion by various impurities mixed in lubricant and the like, and providing the surface of a cam member with an oil film holding function so as to maintain fluid lubrication of the sliding surface.

6 Claims, 3 Drawing Sheets

COMBINATION BODY OF SHIM AND CAM

BACKGROUND OF THE INVENTION

1. Field of the Invention

The present invention relates to an art on combination body of a shim and a cam for use in a valve train mechanism of an internal combustion engine and driving mechanism of a valve train of a high-pressure fuel injection pump of an automobile or the like for improving the durability of mechanism parts by reducing sliding friction resistance and wear loss.

2. Description of the Prior Art

Recently, as an effective means for reducing a mechanical loss of automobile engine to improve fuel efficiency, an art for reducing friction loss of the engine mechanical portion has been proposed. Among others, reducing a friction loss of the shim and cam in the valve train mechanism which has a high sliding speed and a high load is very effective in improving the fuel efficiency.

On the other hand, in an in-cylinder direct fuel injection engine in which gasoline or light oil is injected directly into a combustion chamber, the shim and cam for use in the reciprocating mechanism for obtaining a fuel feeding pressure are sliding parts which slide under a strict condition. Reducing the friction loss of these parts is an important technology for improving the performance and durability of the fuel injection pump. Particularly, in the fuel injection train for the in-cylinder direct fuel injection engine, it has been demanded that by converting a conventional roller follower type with a cam and a cam roller made of steel used as intermediaries to a slipper follower type in which the shim and cam materials are improved, reductions in the number of parts, size and weight thereof are achieved, thereby reducing production cost.

And, the conversion from the roller follower type to the slipper follower type is achieved by minimizing a friction loss between members in a frictional interface. As regards the friction-loss, if the reciprocating mechanism portion exists in lubricant environment, generally it has been considered that the minimum gap between the members or the minimum oil film thickness and characteristic of the sliding surface affects/affect the sliding characteristic and friction-loss.

The aforementioned friction-loss is quantified by the following formula (1).

$$F=A\{\alpha Sm+(1-\alpha)St\} \quad (1)$$

where, F: friction-loss, A: sliding area, α: oil film fracture area ratio, Sm: shearing strength of a member in case where a mating member is in direct contact, St: shearing strength of oil film, αSm: friction-loss (friction-loss under boundary lubricating condition) in a case where no oil film exists, and (1−α)St: friction-loss (friction-loss under fluid lubrication) in a case where an oil film exists completely. Here, in order to decrease the friction-loss F, it is necessary to increase the term of the friction-loss under fluid lubrication and decrease α because usually Sm is larger than St.

Further, in order to maintain a complete fluid lubrication state, it is important to control the nature of the sliding surface of the mating sliding member. The oil film parameter Λ indicating a degree of lubrication is quantified by the formula (2). Increasing this value Λ is effective for maintaining the fluid lubrication.

$$\Lambda=hmin/\sqrt{(Rrms1^2+Rrms2^2)} \quad (2)$$

where, hmin: minimum gap between mating sliding members or minimum oil film thickness, Rrms1: mean-square roughness of the surface of one of the sliding members, and Rrms2: means-square roughness of the surface of the other of the sliding members. Therefore, it is understood that if the surface roughness of the mating sliding members is made fine, it is effective for maintaining the fluid lubrication.

On the basis of the above mentioned technical background, in JP-A-7-98052 there is proposed an art on the combination body of the shim and cam, in which the sliding surface roughness of the shim composed of ceramic containing silicon nitride or SIALON is made less than $R_z$0.1 μm in 10-point mean roughness, and the surface of the cam made of cast iron is chill hardened and phosphate coating film is formed thereon.

According to this conventional art, the surface roughness of the cam is improved during a running-in operation or initial phase of the operation so as to reduce a friction-loss at a portion to be subjected to boundary lubrication, thereby the sliding characteristic between the shim and cam being improved. As a result, cam shaft driving torque can be largely reduced. Further, it is explained therein that since the surface roughness of the cam can be improved during the running-in operation, the friction-loss can be reduced even if any special ultra precision finish processing is not carried out on the surface of the cam having a complicated shape, and this is very effective also in economic viewpoint.

In case where the slipper follower type is employed, it is necessary to choose the material of the shim and cam capable of suppressing as much as possible the boundary lubrication which is likely to occur if the surface pressure goes high even in the lubricant environment. That is, it is necessary to choose the material having Sm characteristic which unlikely undergoes plastic deformation by a direct contact with a mating member or deterioration of the surface roughness due to corrosion or the like by various impurities mixed in lubricant. Particularly, the shim having a flat sliding surface is easy to have a fine surface roughness by ultra precision processing even if a material having a high hardness is chosen, so that means for maintaining this hmin characteristic stably should be added. Further, if the surface of the cam member is provided with means for accelerating the hmin characteristic, it is effective for maintaining the fluid lubrication. The present invention proposes an art for solving these problems.

SUMMARY OF THE INVENTION

In the combination body of the shim and cam for use in the reciprocating mechanism portion, the shim is made of a material having a hardness higher than the sliding surface of the cam and the sliding surface of the shim is finished in a range of $R_z$0.07–0.2 μm in terms of 10-point mean surface roughness. As to the sliding surface of the cam, fluid lubricating condition is maintained by utilizing the open pores existing in the surface of the cam member.

For the shim member, ceramic composed of silicon nitride or SIALON is chosen, and for the cam member, iron-base alloy sintered body is used and the pores dispersed inside the sintered body are utilized. The sliding surface of the cam is treated by etching with acid so as to control the open pores so that the area ratio thereof is 2–6% and the maximum diameter is less than 50 μm, thereby improving the oil film holding function.

The shim member has the surface of the steel material coated with a coating film of ceramic composed of nitride or carbide of Cr and Ti or a coating film of diamond or DLC. The cam member is made of the iron-base alloy sintered body and the cam member hardness is increased by heat treatment. As a result, the wear resistance of both is improved.

DETAILED DESCRIPTION OF THE PREFERRED EMBODIMENTS

Figure 1:
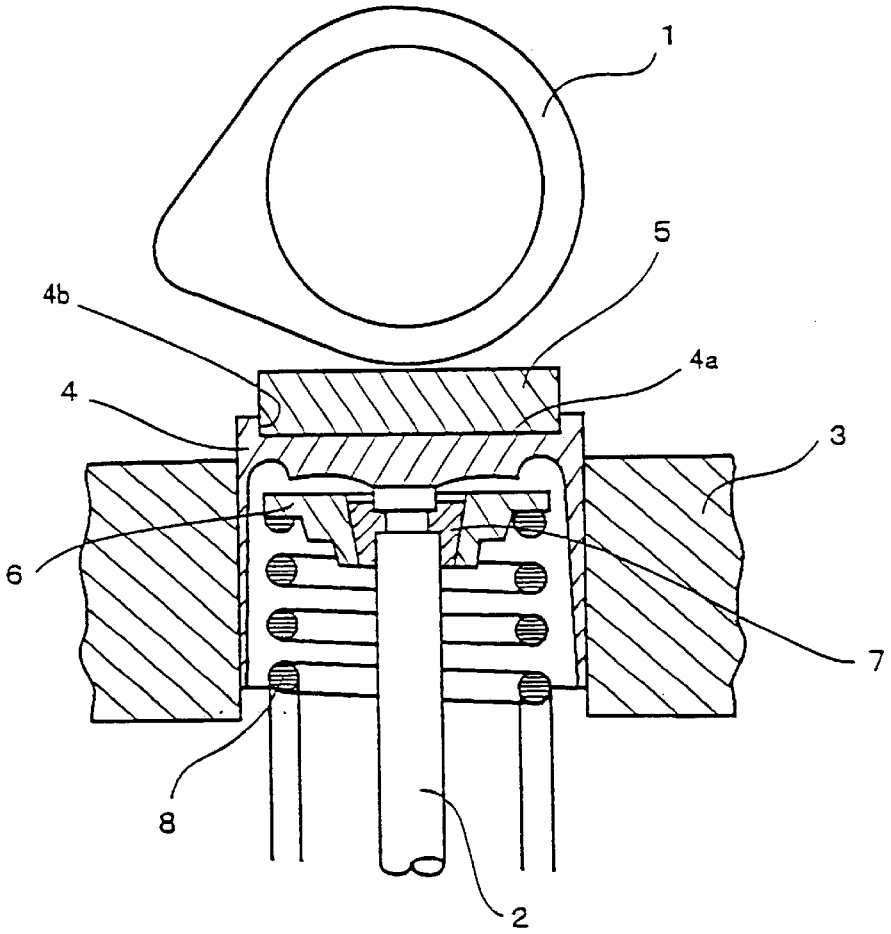
FIG. 1 is an embodiment in which the present invention is applied to the valve train mechanism of an internal combustion engine.

Hereinafter, embodiments preferable for the present invention will be described in detail. FIG. 1 shows an application example in which a combination body of a shim and a cam of the present invention is applied to a valve train mechanism of an internal combustion engine and FIG. 2 shows an application example to a fuel injection pump.

In FIG. 1, in a direct acting type intake/outlet valve, its valve 2 is reciprocated relative to a combustion chamber of an engine along a profile of the cam 1 with rotations of the cam 1. A concave portion 4*a* in which the shim 5 is seated is provided in an end face of a valve lifter 4 supported by a cylinder block 3. The shim 5 is a member for maintaining an accuracy of the opening/closing action of the valve 2 by countervailing accumulated errors of parts such as the cam 1 and the valve lifter 4 by adjusting a thickness thereof. Therefore, the shim 5 may be seated by means of being captured by a side wall 4*b* of the concave portion 4*a,* fitted by caulking, or bonded by brazing and the like. An end face of the valve 2 fixed to a spring retainer 6 with a cotter 7 is always urged by a spring 8, so that it abuts on an interior of the valve lifter 4.

Thus, when the valve 2 is reciprocated with rotations of the cam 1 for intake and outlet of the engine, contact portions of the cam 1 and shim 5 slide relative to each other with a locally high surface pressure. Therefore, wear resistance and heat resistance are demanded and it is necessary to select a material having a small mechanical loss due to friction.

Figure 2:
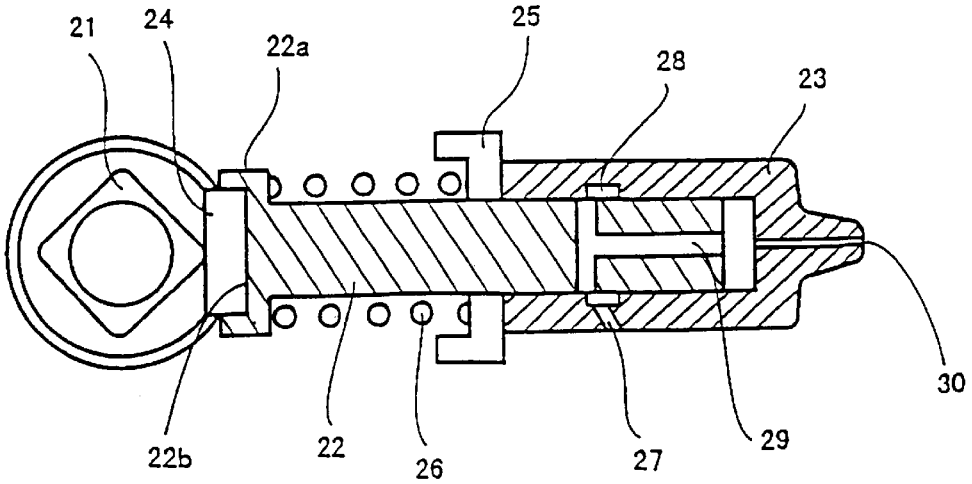
FIG. 2 is an embodiment in which the present invention is applied to a fuel injection pump of an internal combustion engine.

On the other hand, in a principle fuel injection pump shown in FIG. 2, a plunger 22 reciprocated with rotations of the cam 21 is accommodated slidably in a cylinder body 23 and a shim 24 is seated in a concave portion 22*b* provided in a flange 22*a* of the plunger 22. A spring 26 is provided contractedly between a spring retainer 25 and the flange 22*a* so that the shim 24 is always urged so as to abut on the profile of the cam 21. Fuel fed under pressure through another path reaches an annular chamber 28 from a fuel port 27. When a discharge port 29 disposed at a front end of the plunger 22 communicates with the annular chamber 28, fuel is fed to a fuel injector through the exit 30.

At a lower dead point of the cam 21, the communication between the discharge port 29 and annular chamber 28 is interrupted, so that fuel injection is stopped. Anyway, the combination body of the shim and cam for use in the fuel injection pump needs to satisfy the same required characteristic as the shim 5 and cam 1 of FIG. 1. Hereinafter, a case in which it is used in the valve train mechanism will be described as an example.

The shim 5 and cam 1 are desired to be as hard as possible so as not to accelerate plastic deformation and wear due to a direct contact with mating member. Particularly, since the shim 5 is of a simple configuration, even if a material harder than the cam 1 is selected, it is easy to obtain a fine sliding surface by ultra precision processing for maintaining fluid lubrication. Further, ceramic is a preferable material for preventing corrosion by various impurities mixed in lubricant.

Particularly, in ceramic containing more than 80 weight % of silicon nitride or SIALON, an average value of bending strength based on JIS R 1601 "Bending Strength Test Method for Fine Ceramic" is more than 700 MPa and its impact resistance is higher than general ceramic. And, if the sliding surface is finished to $R_z$0.07–0.2 $\mu$m in 10-point mean surface roughness, it is effective for reducing a friction loss F of the formula (1).

However, the ceramic has a weak point that it is brittle although it is hard. Therefore, in order to compensate for the weak point, it is effective to form the shim 5 with metallic alloy material such as structural carbon steel, carbon tool steel, and alloy tool steel as its base material and cover that material with hard coating film to obtain a further hardening and corrosion resistance of the surface. For example, after SCM420 specified as JIS G 4105 "Chromium Molybdenum Steel Material" is heat treated, if the sliding surface is finished to $R_R$0.07–0.2 $\mu$m in the 10-point mean surface roughness and that material is coated with nitride or carbide of Cr and Ti having a film thickness of about 0.5–5 $\mu$m or with diamond or DLC by physical vapor deposition (PVD) such as ion plating or chemical vapor deposition (CVD). Incidentally, a smooth hard coating film can be obtained without losing the surface roughness of the base material. Incidentally, a coating film generation condition should be considered so as to maintain an appropriate adhesion strength with the base material so that the coating film made of the ceramic, diamond or DCL is not peeled by a sliding relative to the mating material.

On the other hand, if it is intended to use a hard material for the cam 1 and treat the material so as to have a fine surface, thereby increasing the oil film parameter $\Lambda$ of the formula (2) to maintain a fluid lubrication, it takes a large number of manhours. According to the conventional art, as the material of the cam 1, although chilled cast iron is used in order to reduce processing manhours, iron-base alloy sintered body is used in the present invention.

In the cam 1 formed by a well-known powder metallurgy, an excellent lubricity can be obtained by effectively using appropriate pores dispersed inside, an appropriate mechanical strength can be obtained by mixing additive metallic element and further an appropriate hardness can be obtained by heat treatment. In viewpoints of powder compressibility and economical performance, it is preferable to use a low alloy which contains, as additive metallic elements, for example, 1.5% Mo, 0.3% Cu, 0.8% C by weight, unavoidable elements and balance Fe and whose total content of additive components is lower than 10%. A sintered body of the cam 1 having a through hole at a predetermined position which is fit to the cam shaft is integrated with the cam shaft by brazing, diffused sintering bonding or the like.

As for the heat treatment, the sintered body is cooled rapidly from austenite phase which is a high temperature phase to obtain martensite phase having a uniform hardness while being compressed in a die during a process for forming the sintered body, and then tempering processing is carried out. As a result, the surface hardness of the cam 5 is adjusted to about 550–700 in Vickers hardness and the surface roughness is maintained to less than $R_Z5$ μm. Further, heat-treating the sintered body while compressing it in the die provides an effect of suppressing thermal distortion and dimensional change of the profile of the cam 1.

Figure 3:
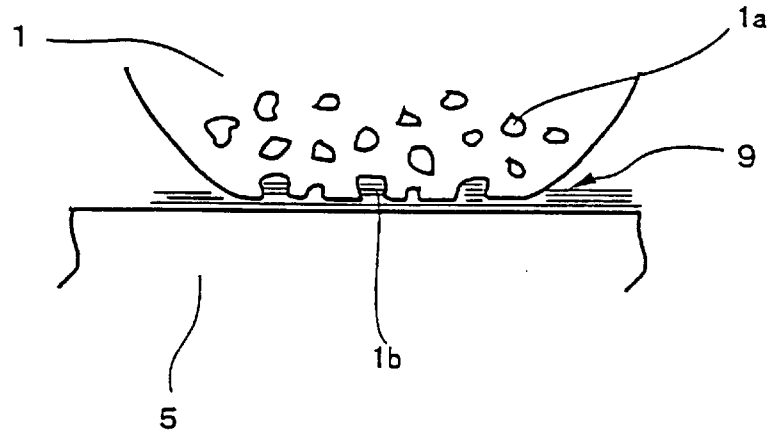
FIG. 3 is a locally enlarged view of a sliding interface between a shim and a cam in the present invention.

FIG. 3 shows the sliding interface between the shim 5 and cam 1 in a locally enlarged state. Among pores la dispersed inside the sintered body of the cam 1, those existing near the surface form open pores 1*b* as oil pit by etching with acid, so that it is possible to improve the maintainability for the oil film 9. The open pores 1*b* formed by the etching are desired to be controlled so that the area ratio is 2–6% and the maximum opening diameter is 50 μm. By providing the surface of the cam 1 with the open pores 1*b* in this manner, the oil film parameter Λ shown in the formula (2) can be increased.

Figure 4:
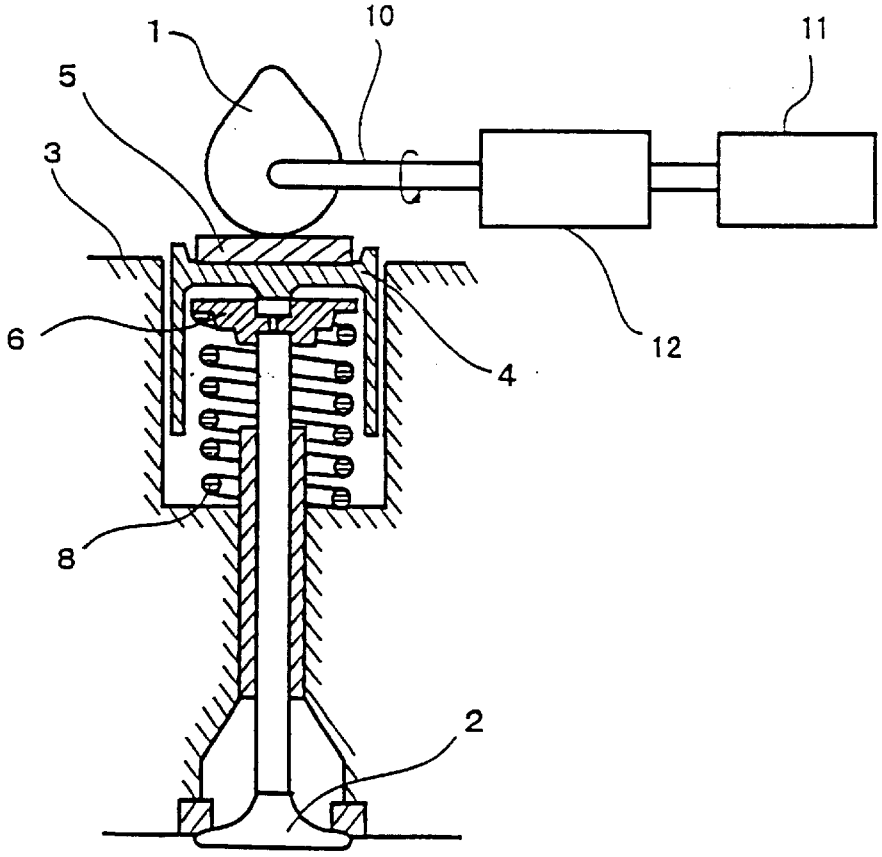
FIG. 4 is a schematic view of an evaluation test apparatus in the present invention.
Figure 5:
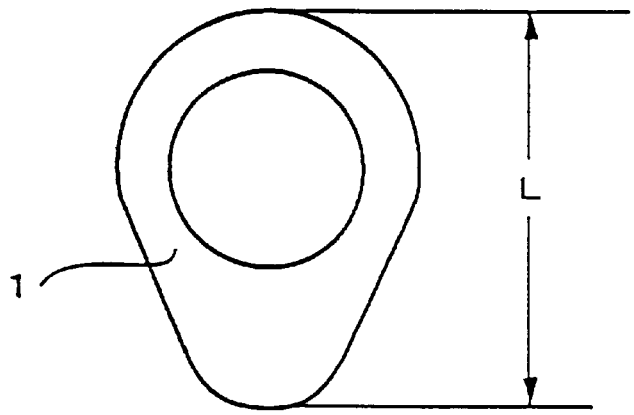
FIG. 5 is an explanatory view of a measuring portion for the cam wear loss in the present invention.

Next, a result of evaluation test on the combination body of the shim and cam constructed according to the above technological thought will be described. FIG. 4 shows a schematic view of the test apparatus. A motor 11 for driving a cam shaft 10 and a torque meter 12 for measuring a torque generated in the combination body of the shim and cam were installed on a valve train mechanism of a four-cylinder engine having a displacement of 1800 cc. Additionally, a pump (not shown) for supplying lubricant was provided. Then, a generated torque and wear loss of the cam 1 were measured. As the wear loss of the cam 1, L shown in FIG. 5 was measured.

As the specimen of the shim and cam based on the conventional art, those of the following specification were provided. A shim having a thickness of 3 mm and made of ceramic containing silicon nitride of more than 60 volume % was ground with a diamond grinding wheel to $R_z0.2$ μm in 10-point mean roughness. As for the cam made of cast iron, the surface was chill hardened and phosphate film was formed, and then the surface was machined to $R_z3.2$ μm in 10-point mean roughness.

As the shim 5 of the present invention, shims having a thickness of 3 mm and made of ceramic (850 MPa in 3-point bending strength based on JIS R 1601) containing silicon nitride ($Si_3N_4$) of more than 80 weight % was ground with a diamond grinding wheel, lapped with diamond grains and then polished. Thereby, three kinds of specimens in surface roughness having $R_z0.4$, $R_z0.2$ and $R_z0.1$ μm in 10-point mean roughness were prepared.

Further, an SCM420 having a thickness of 3 mm was heat treated as a base material and it was coated with hard coating film by vapor deposition. By subjecting the shims 5 made of heat treated SCM420 to the same ultra precision processing, four kinds of specimens each having surface roughness of $R_z0.4$, $R_z0.2$, $R_z0.1$ and $R_z0.07$ μm in 10-point mean roughness were prepared. Of them, those in which nitride of Cr or Ti was applied to the specimens of $R_z0.4$, $R_z0.2$ and $R_z0.1$ in 10-point mean roughness in a film thickness of 3 μm by vapor deposition according to the known method, and those in which diamond or DLC was applied to the specimens of $R_z0.2$ and $R_z0.07$ μm in 10-point mean roughness in a film thickness of 1 μm by vapor deposition according to the well known method were prepared.

As to the cam 1 of the present invention, a material made of iron-base alloy sintered body and having a surface hardness of 650 in Vickers hardness and a uniform martensite phase produced by heat treatment of quench hardening and annealing was subjected to a predetermined machining so as to finish the cam profile to $R_z3.2$ μm in 10-point mean roughness. And, there was prepared the specimen in which the open pores 1*b* as oil sump were controlled by etching with acid so that the area ratio was 5% and the maximum open pore was 40 μm, so as to improve the maintainability for the oil film 9.

Although the operating condition for a normal valve train mechanism is that the sliding speed is 1000–4000 rpm in terms of crank shaft rotation speed and the lubricant temperature is −40 to 150° C., here the cam shaft 10 is set to 2000 rpm and the lubricant temperature is set to 80° C. Changes in generated torque one hour and 500 hours after operation start are expressed as a percentage of those of specimen of the conventional art and wear loss L of the cam after 500 hours is expressed in the unit of μm and described in Table 1.

TABLE 1

| | cam | | shim | | generated torque (%) | | cam wear loss |
|---|---|---|---|---|---|---|---|
| specimen | material | surface roughness Rz:μm | Material | surface roughness Rz:μm | one hour | 500 hours | 500 hours |
| 1 | cast iron | 3.2 | $Si_3N_4$ single phase | 0.2 | 100 | 100 | 95 |
| 2 | sintered iron | 3.2 | $Si_3N_4$ single phase | 0.4 | 108 | 115 | 600 |
| 3 | sintered iron | " | $Si_3N_4$ single phase | 0.2 | 60 | 70 | 65 |
| 4 | sintered iron | " | $Si_3N_4$ single phase | 0.1 | 58 | 70 | 50 |
| 5 | sintered iron | " | CrN film on SCM | 0.4 | 110 | 120 | 650 |
| 6 | sintered iron | " | " | 0.2 | 63 | 75 | 73 |
| 7 | sintered iron | " | " | 0.1 | 58 | 70 | 65 |
| 8 | sintered iron | " | TN film on SCM | 0.2 | 65 | 78 | 70 |

TABLE 1-continued

| | cam | | shim | | generated torque (%) | | cam wear loss |
|---|---|---|---|---|---|---|---|
| specimen | material | surface roughness Rz:μm | Material | surface roughness Rz:μm | one hour | 500 hours | 500 hours |
| 9 | sintered iron | " | " | 0.1 | 58 | 70 | 65 |
| 10 | sintered iron | " | DLC film on SCM | 0.2 | 63 | 75 | 72 |
| 11 | sintered iron | " | " | 0.07 | 52 | 68 | 60 |
| 12 | sintered iron | " | Diamond film on SCM | 0.2 | 65 | 78 | 72 |
| 13 | sintered iron | " | Diamond film on SCM | 0.07 | 51 | 68 | 63 |

In considering a result of Table 1, although the conventional art specimen 1 is finished to $R_z0.2$ in surface roughness, as compared to the specimens 3, 6, 8, 10 and 12 finished to the similar surface roughness of the present invention, the cam wear loss after 500 hours is large. The reason is judged to be a result that the oil film 9 holding function of the open pores 1*b* as oil pit formed on the surface of the cam of the present invention was displayed.

However, it is understood that even for the shim 5 of the present invention its effect is reduced to a half in view of the surface roughness $R_z0.4$ μm of the specimen 2 or 5 even if the oil pit 1*b* exists in the cam 1. However, even if the shim 5 is finished to the surface roughness $R_z0.07$–$R_z0.1$ μm in case of the specimens 4, 7, 9, 11 and 13, the effect is never increased remarkably and even if it is finished to the surface roughness of less than $R_z0.07$ μm, no effect can be expected although manhours expended is increased. Therefore, the surface roughness of the shim 5 is desired to be finished to $R_z0.07$ to 0.2 μm.

Next, the result of evaluation on the relation between the generated torque and the cam wear loss with respect to the number and size of the open pores in the surface of the cam 1 will be described. For this evaluation test, a test apparatus similar to FIG. 4 was used. For the shim 5 of the test specimen, an equivalent to the specimen 4 of Table 1 was prepared. For the cam 1, the surface of the iron base alloy sintered body equivalent to the specimens 2–13 of Table 1 was treated by etching with acid so as to prepare five kinds of the specimens in which the maximum open pore was 40gm and the area ratios were 1% and 2–8% at an increment of 2%.

As the test condition, the cam shaft 10 was set to 2000 rpm and to a lubricant temperature of 150° C. at which viscosity dropped at a high temperature and so the oil film was likely to be broken. The generated torque variation 500 hours after the operation start is expressed as a percentage of the combination of the specimen 1 in Table 1 which is the conventional art. Further, the cam wear loss L after 500 hours is described in the unit of μm in FIG. 6.

Figure 6:
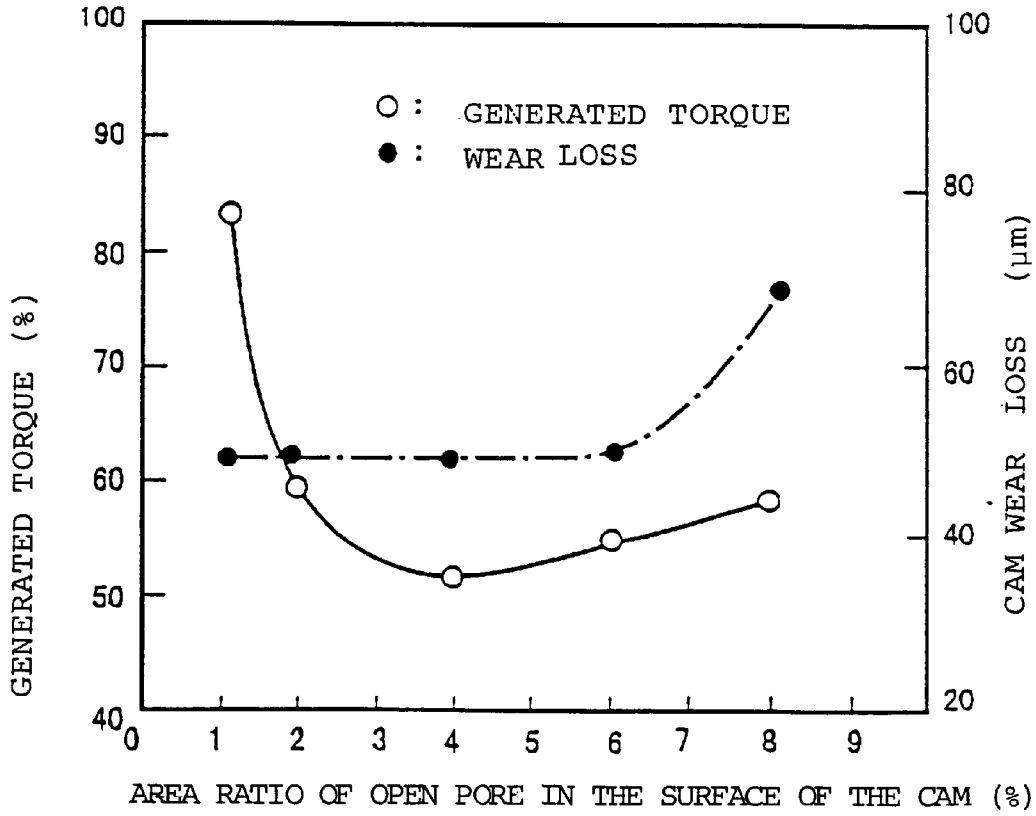
FIG. 6 is a measurement result showing the relation between the open pores in the cam surface, generated torque and cam wear loss.

In considering a result in changes of the generated torque of FIG. 6, if the area ratio of the open pores 1*b* in the surface of the cam 1 is less than 2%, the capacity for holding the oil film 9 is low because the open pores as the oil pit are not dispersed sufficiently. If the area ratio is more than 6%, although the capacity for holding the oil film necessary for lubrication is maintained, the strength of the cam 1 drops and further the surface roughens is reduced by a wear induced thereby, so that some increase of the generated torque poses a problem. As for the cam wear loss, if the area ratio of the open pores 1*b* exceeds 6%, it is understood that the injection pump contact between the uneven sliding surface of the cam 1 and the shim 5 is increased, so that the wear is accelerated. Therefore, in order to maintain a stable fluid lubrication, it is desirable to control the open pores 1*b* so that the area ratio is 2–6% and the maximum diameter is less than 50 μm.

For the shim of the combination body of the shim and cam according to the present invention, since a material harder than the cam is selected and the sliding surface thereof is subjected to ultra precision processing to $R_z0.07$–0.2 μm in surface roughness, the fluid lubrication can be maintained. Further, the shim made of ceramic consisting of more than 80 weight % of silicone nitride or SIALON is preferable for preventing corrosion due to various impurities mixed in lubricant and excellent also in impact resistance. And, by vapor-depositing the coating film made of nitride or carbide of Cr and Ti and diamond or DLC on the surface of the shim base material composed of metal alloy material, the surface hardness, the impact resistance and corrosion resistance can be improved.

On the other hand, the cam is formed of iron-base alloy sintered body and heat treated, and then its sliding surface is subjected to etching treatment with acid so as to provide the open pores whose the area ratio is 2–6% and the maximum diameter is 50 μm, thereby improving the oil film holding function. Therefore, a stable fluid lubrication condition can be maintained and the cam wear loss can be improved by 20–30% as compared to the combination of the shim and cam of the conventional art.

What is claimed is:

1. Combination body of shim and cam for use in a reciprocating mechanism portion, wherein said shim is made of a material having a hardness higher than a sliding surface of said cam, the sliding surface of said shim is finished to within a range of $R_z0.07$–0.2 μm in 10-point mean surface roughness, and wherein the shim member is made of a metallic alloy material with a ceramic surface coating film which includes nitrides or carbides of Cr or Ti; and the sliding surface of said cam is provided with open pores, and the cam member is made of an iron-base alloy sintered body.

2. Combination body of shim and cam as claimed in claim 1, wherein the sliding surface of the cam made of iron-base alloy sintered body has open pores with an area ratio of 2–6% and maximum diameter of less than 50 μm.

3. Combination body of shim and cam as claimed in claim 2, wherein the open pores of the cam member existing in the sliding surface of the cam are controlled by etching with acid treatment in the number and size of the open pores in the surface.

4. Combination body of shim and cam for use in a reciprocating mechanism portion, wherein said shim is made of a material having a hardness higher than a sliding surface of said cam, the sliding surface of said shim is finished to within a range of $R_z$0.07–0.2 $\mu$m in 10-point mean surface roughness, and wherein the shim member is made of a metallic alloy material with a diamond or DLC coating film; and the sliding surface of said cam is provided with open pores, and the cam member is made of an iron-base alloy sintered body.

5. Combination body of shim and cam as claimed in claim 4, wherein the sliding surface of the cam made of iron-base alloy sintered body has open pores with an area ratio of 2–6% and maximum diameter of less than 50 $\mu$m.

6. Combination body of shim and cam as claimed in claim 5, wherein the open pores of the cam member existing in the sliding surface of the cam are controlled by etching with acid treatment in the number and size of the open pores in the surface.

* * * * *